United States Patent [19]

Hirschey

[11] 4,422,437

[45] Dec. 27, 1983

[54] CATALYTIC FIREBOX

[76] Inventor: Dareld A. Hirschey, 121 6th Ave., SE., Glenwood, Minn. 56334

[21] Appl. No.: 483,539

[22] Filed: Apr. 11, 1983

[51] Int. Cl.[3] ..... F24C 1/14

[52] U.S. Cl. ..... 126/77; 126/109; 126/112; 126/61; 126/72; 110/211; 110/210; 422/183

[58] Field of Search ..... 126/99 A, 109, 112, 126/61, 66, 92 C, 72, 77, 83; 110/203, 211, 210; 422/173, 176, 187, 183, 182; 431/DIG. 1

[56] References Cited

U.S. PATENT DOCUMENTS

| | | | |
|---|---|---|---|
| 4,319,556 | 3/1982 | Schwartz et al. | 126/77 |
| 4,330,503 | 5/1982 | Allaire et al. | 126/163 R X |
| 4,363,785 | 12/1982 | Willson | 126/77 X |
| 4,372,286 | 2/1983 | Baker | 126/77 |

*Primary Examiner*—Samuel Scott
*Assistant Examiner*—Randall L. Green
*Attorney, Agent, or Firm*—Harvey B. Jacobson

[57] ABSTRACT

A housing is provided defining a closed lower combustion chamber and a closed upper afterburn chamber disposed immediately above the combustion chamber with one marginal portion of the combustion chamber projecting horizontally outwardly beyond the corresponding marginal portion of the afterburn chamber. A combined flue gas and bypass chamber is disposed above the one marginal portion of the combustion chamber and is horizontally registered with the afterburn chamber. Partition structure divides the combined flue gas and bypass chamber into central and remote end portions spaced along the aforementioned one marginal portion and a pair of first ports communicate the remote portions with adjacent underlying upper portions of the combustion chamber, a pair of second ports communicate the remote portions with adjacent portions of the afterburn chamber and third port structure communicates the central portion of the afterburn chamber with the central portion of the combined chamber. Further, fourth port structure communicates the central portion of the afterburn chamber with an underlying central upper portion of the combustion chamber. Catalytic combuster structure is disposed in the first ports and damper structure is operatively associated with the fourth port structure for variably opening and closing the latter. Flue gas outlet structure opens outwardly of the central portion of the combined chamber, combustion air inlet structure opens into the combustion chamber and supplemental combustion air inlet structure opens into the combustion chamber closely adjacent the combuster structure.

12 Claims, 5 Drawing Figures

CATALYTIC FIREBOX

BACKGROUND OF THE INVENTION

Many different forms of liquid and gaseous fuel fireboxes heretofore have been designed for high efficiency combustion whereby a substantially maximum amount of heat is produced from a given amount of fuel. However, solid fuel burning fireboxes of the type which may be built into a fireplace are noted for inefficiency of combustion. Accordingly, although many households are turning toward wood burning fireplace and built-in fireplace fireboxes, these built-in fireboxes do not enjoy high efficiency combustion. Accordingly, a need exists for a firebox which may be constructed in the form of a built-in firebox for a fireplace and which may burn solid fuel such as wood in a highly efficient manner.

Examples of fireboxes including some of the general structural and operational features of the instant invention are disclosed in U.S. Pat. Nos. 1,752,007, 2,845,882, 4,013,059, 4,126,118 and 4,223,833.

BRIEF DESCRIPTION OF THE INVENTION

The firebox of the instant invention is constructed in the form of a housing which may be utilized as a firebox built into a masonry fireplace enclosure. The housing defines a closed lower combustion chamber and a closed upper afterburn chamber disposed above the combustion chamber with the rear marginal portion of the combustion chamber projecting rearwardly of the corresponding marginal portion of the afterburn chamber. A combined flue gas and bypass chamber is disposed above the rear marginal portion of the combustion chamber and is horizontally registered with the afterburn chamber. Partition structure is included in the combined flue gas and bypass chamber and divides the latter into central and opposite side portions spaced along the rear marginal portion of the firebox. A first pair of vertical ports communicate the opposite side portions of the combined flue gas and bypass chamber with opposite side upper portions of the combustion chamber, a second pair of generally horizontal front to rear opening ports communicate the opposite side portions of the combined flue gas and bypass chamber with opposite side portions of the afterburn chamber, horizontal front to rear extending third ports communicate the central portion of the combined flue gas and bypass chamber with the central portion of the afterburn chamber and vertically extending fourth port structure communicates the central portion of the combined flue gas and bypass chamber with the central portion of the upper rear area of the combustion chamber. Damper structure is operatively associated with the fourth port structure for variably opening and closing the same, flue gas outlet structure opens outwardly of the central portion of the combined flue gas and bypass chamber and combustion air inlet structure opens into a lower portion of the combustion chamber while supplemental combustion air inlet structure opens into the combustion chamber closely adjacent combuster structure disposed within the first ports.

Upon initial burning of a wood fire within the combustion chamber the damper is retained open whereby flue gas from the combustion chamber may pass directly upwardly into the combined flue gas and bypass chamber and outwardly therefrom through the flue gas outlet. However, after the fire within the combustion chamber has heated the housing and the temperature of the fire has been increased to a proper level, the damper may be closed whereby all of the flue gases must pass through the first ports and the combuster structure immediately before which the supplemental combustion air is admitted into the combustion chamber. The supplemental combustion air mixes with the unburned portions of the flue gas and supports combustion of the latter as it passes through the combuster grids. The burning flue gases then pass through the first ports as well as the second ports and into the afterburn chamber before passing outwardly therefrom through the third ports and into the combined flue gas and bypass chamber for ultimate exit through the flue gas outlet. As the normally unburned flue gases are burned within the afterburn chamber, considerable additional amounts of heat are generated. The upper portion of the combustion chamber includes heating air pipes extending transversely therethrough whereby additional amounts of heat may be produced and all but the access door at the front of the housing may be enclosed within a structure through which air to be heated may be pumped in addition to the air being pumped through the aforementioned heating air pipes.

The main object of this invention is to provide a solid fuel burning firebox constructed in a manner whereby solid fuel such as wood may be burned in a highly efficient manner.

Another object of this invention is to provide a firebox in accordance with the preceding object and utilizing combuster structure in conjunction with supplemental air inlet structure to provide a means whereby the normal highly heated unburned portions of the flue gases developed by a wood burning fire may be burned substantially completely within the firebox.

Still another object of this invention is to provide a firebox constructed in a manner whereby it may be built into a masonry fireplace.

Another important object of this invention is to provide an improved firebox which is capable of utilizing outside air for supporting initial combustion as well as afterburn of the normally unburned gaseous by-products of a wood fire.

A final object of this invention to be specifically enumerated herein is to provide an improved firebox in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
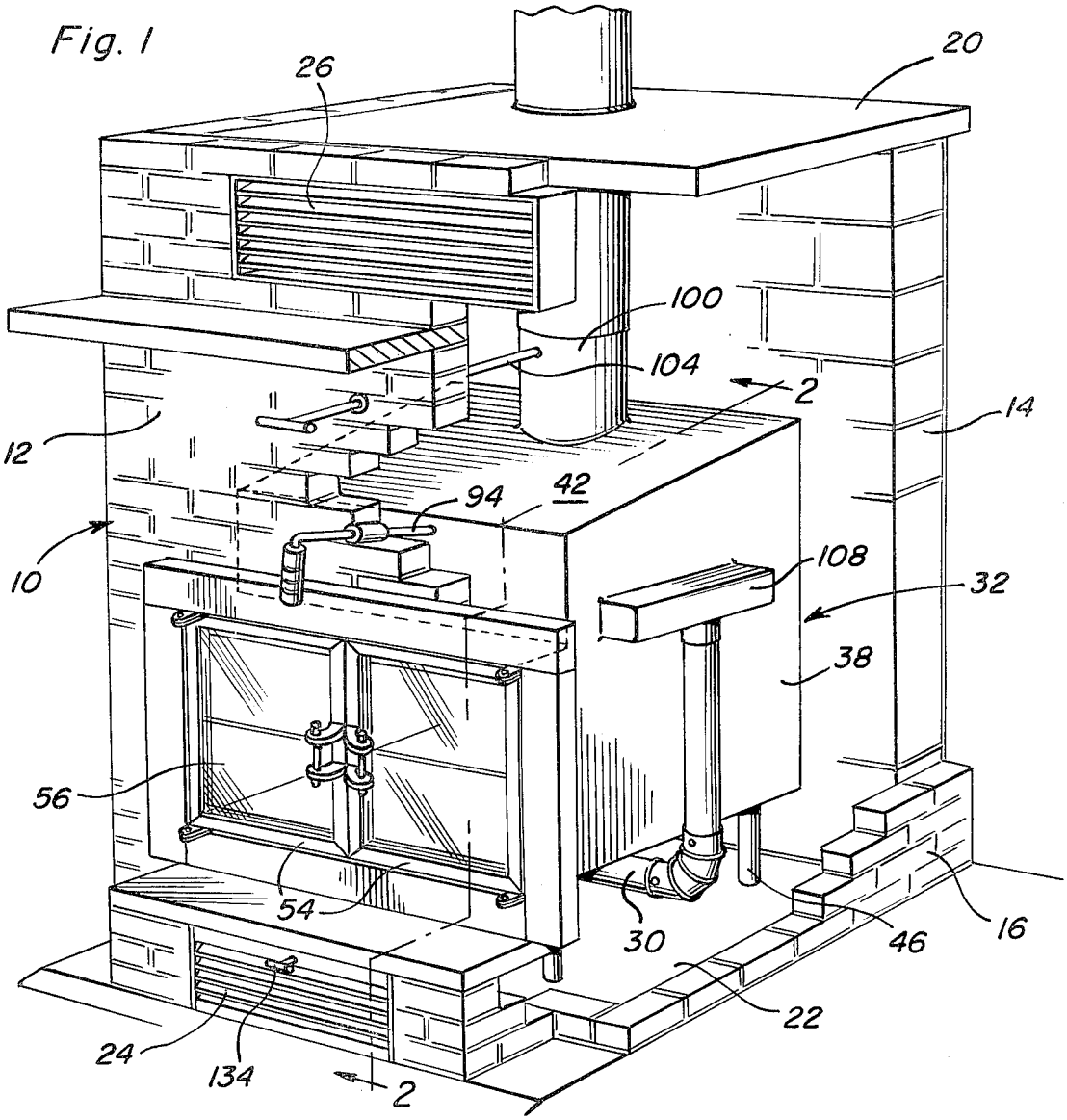
FIG. 1 is a perspective view of the firebox of the instant invention illustrated enclosed within a masonry chamber such as may be incorporated in the construction of a fireplace and with portions of the masonry chamber being broken away.

Referring now more specifically to the drawings the numeral 10 generally designates a masonry enclosure including front and rear walls 12 and 14, opposite side walls 16 and 18 and a precast top wall 20. The bottom of the enclosure 10 includes any suitable form of floor structure 22.

The enclosure 10 may be incorporated into the construction of a fireplace type structure or may comprise an enclosure of the free standing type.

The lower portion of the front wall includes a circulating air inlet 24 and the central upper portion of the front wall 12 includes a heated air outlet 26. Immediately inwardly of the air inlet 24 is disposed a double squirrel cage blower assembly referred to in general by the reference numeral 28 and one squirrel cage of the blower assembly 28 is inoperative to pump air into the interior of the enclosure 10 while the other squirrel cage is operative to pump air into an air passage duct 30 to be hereinafter more fully set forth.

The firebox of the instant invention is referred to in generaly by the reference numeral 32 and is contained completely within the enclosure 10. The firebox 32 includes front and rear walls 34 and 36, opposite side walls 38 and 40 and top and bottom walls 42 and 44, the bottom wall 44 including depending legs 46 which support the firebox 32 above the floor structure 22 for the enclosure 10.

The front wall 12 includes an opening 48 formed therein into which a forwardly projecting lower portion 50 of the firebox 32 projects. The portion 50 defines an access opening 52 through which solid fuel may be admitted into the interior of the firebox 32 and the opening 52 is closed by double hinged doors 54 provided with glass panels 56.

The firebox 32 defines a lower combustion chamber 58 therewithin terminating upwardly at a horizontal baffle 60 above which a forward afterburn chamber 62 is defined and a rearward combined flue gas and bypass chamber 64 is defined. The chambers 62 and 64 are separated by a forwardly and upwardly inclined partition 66 and a pair of front to rear extending partitions 68 and 70 divide the combined flue gas and bypass chamber 64 into opposite side portions 72 and 74 and a central portion 76.

Figure 4:
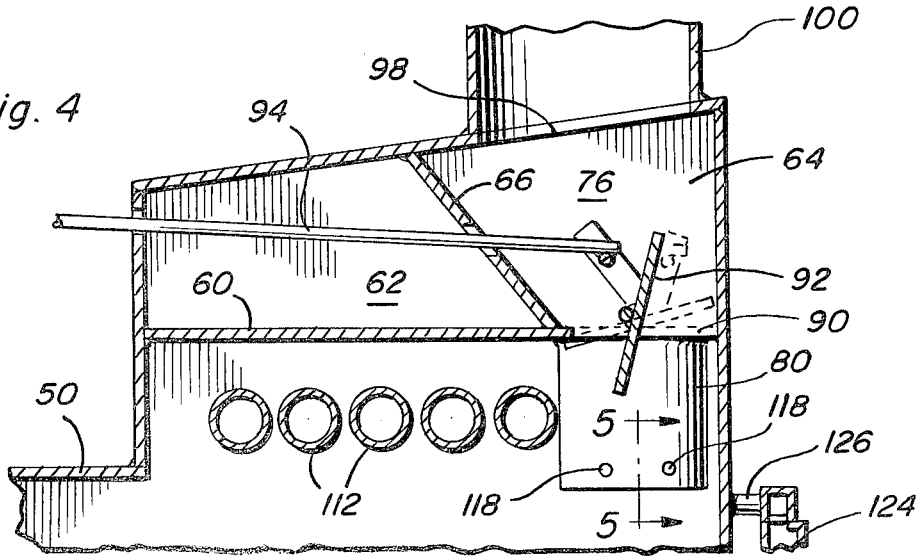
FIG. 4 is a fragmentary vertical sectional view taken substantially upon a plane passing through the central portion of the afterburn chamber.

The baffle 60 includes a pair of depending port tubes 78 and 80 opening downwardly therethrough into opposite side upper portions of the combustion chamber 56 and which communicate opposite side upper portions of the combustion chamber 56 with the opposite side portions 72 and 74 of the combined flue gas and bypass chamber 64. In addition, a pair of ports 82 and 84 are formed through partition 66 and communicate the opposite side portions 72 and 74 of the combined flue gas and bypass chamber 64 with opposite side portions of the afterburn chamber 62. A further pair of ports 86 and 88 are formed through the partition 66 and communicate the central portion of the afterburn chamber 62 with the central portion 76 of the combined flue gas and bypass chamber 64. Finally, a port 90 is formed through the central rear portion of the baffle 60 and communicates the central portion 76 of the combined flue gas and bypass chamber 64 with the upper rear central portion of the interior of the combustion chamber 58 and a pivoted damper plate 92 is operatively associated with the port 90 and includes a forwardly projecting control rod 94 therefor projecting forwardly from the firebox 32 through a sleeve 96 provided therefor in the front wall 12. As can best be seen from FIGS. 1, 2 and 4 of the drawings, the upper central portion of the top wall 42 includes a flue gas outlet port 98 formed therein in which the lower end of a flue pipe 100 is secured and the flue pipe 100 includes a rotatable damper 102 therein provided with a forwardly projecting rotatable control rod 104 also received through a sleeve 106 passing through the front wall 12.

The side walls 38 and 40 include manifold boxes 108 and 110 supported therefrom into which the opposite ends of upper transverse heating air pipes 112 open and it may be seen from FIG. 2 of the drawings that the heating air pipes 112 extend transversely of the upper portion of the interior of the combustion chamber 58 closely below the baffle 60. The duct 30 open into the manifold box 108 and a discharge pipe 114 opens outwardly from the manifold box 110 and through the side wall 18. Accordingly, the blower assembly 28 not only serves to circulate air to be heated about the exterior of the firebox 32 but also through the pipes 112 within the firebox 32. The air circulated about the exterior of the firebox 32 is discharged from the enclosure 10 through the outlet 26 and heated air pumped through the heating air pipes 112 is discharged from the enclosure 10 through the pipe 114 to a remote location.

Each of the port tubes 78 and 80 removably supports a circular catalytic grid-type combuster 116 therein by removable pins 118 which may be removed from within the combustion chamber 58. After the pins 118 have been removed, the combusters 116 may be slid downwardly from the port tubes 78 and 80 and replaced if desired. In addition, the forward portion of the bottom wall 44 includes a combustion air inlet 120 opening upwardly therethrough and outside air is supplied to the inlet 120 through a pipe 122. In addition, a supplemental air inlet pipe opens outwardly from the pipe 122 and passes upwardly behind the rear wall 36 and terminates in a pair of forwardly opening discharge tubes 126 opening into the interior of the combustion chamber 58 through the rear wall 36 thereof immediately below the lower ends of the port tubes 78 and 80. By discharging fresh air from the tubes 126 into the lower portion of the port tubes 78 and 80 immediately below the combusters 116, sufficient additional fresh air is added to the highly heated unburned flue gases in order to enable combustion thereof as they pass through the highly heated combusters 116. This burning gas then moves upwardly into the opposite side portions 72 of the combined flue gas and bypass chamber 64 and thereafter through the ports 82 for further burning in the afterburn chamber 62. In this manner, substantially complete combustion of fuel within the firebox 32 is effected.

Figure 2:
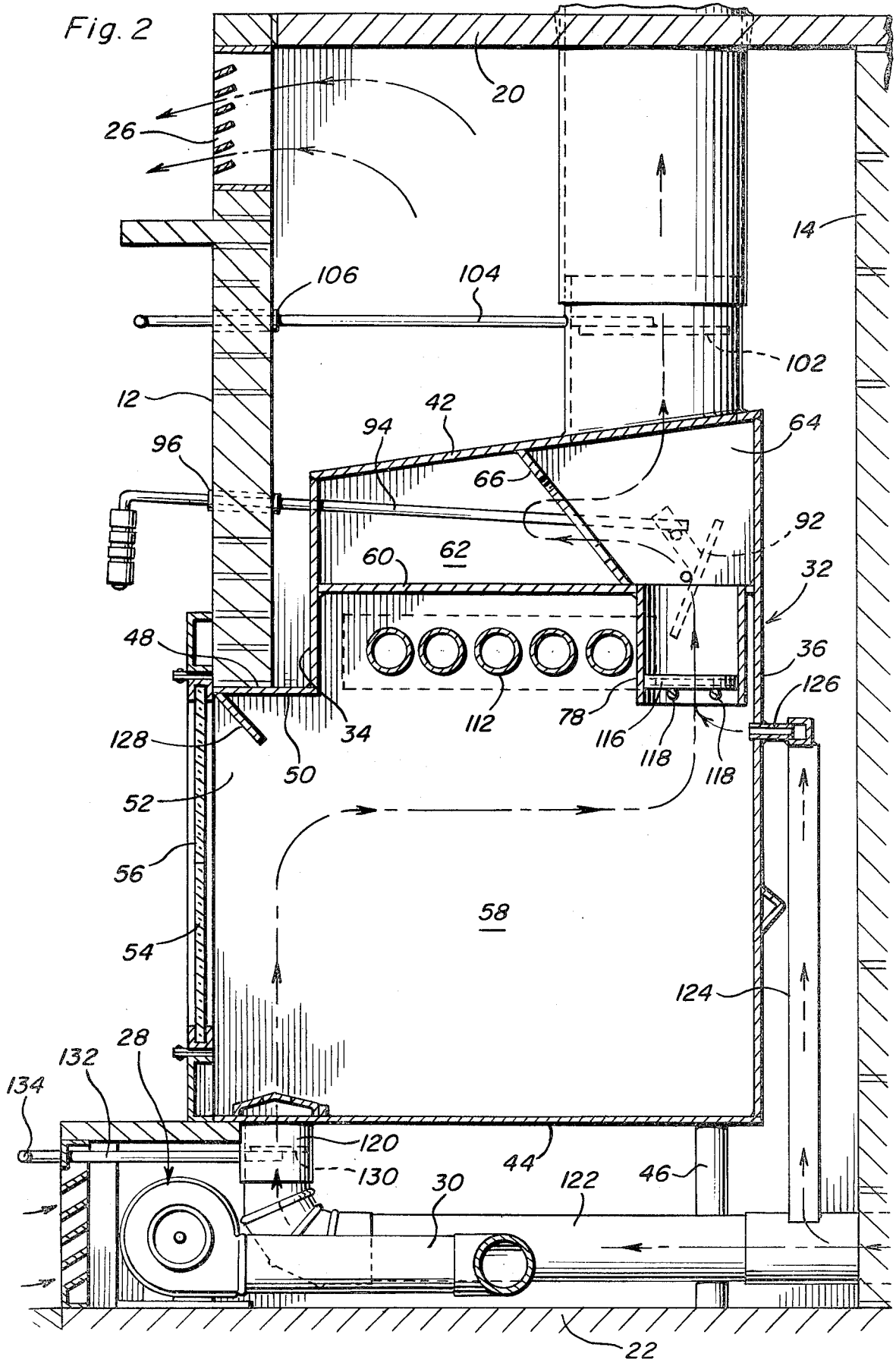
FIG. 2 is an enlarged vertical sectional view taken substantially upon the plane indicated by the section line 2—3 of FIG. 1.
Figure 3:
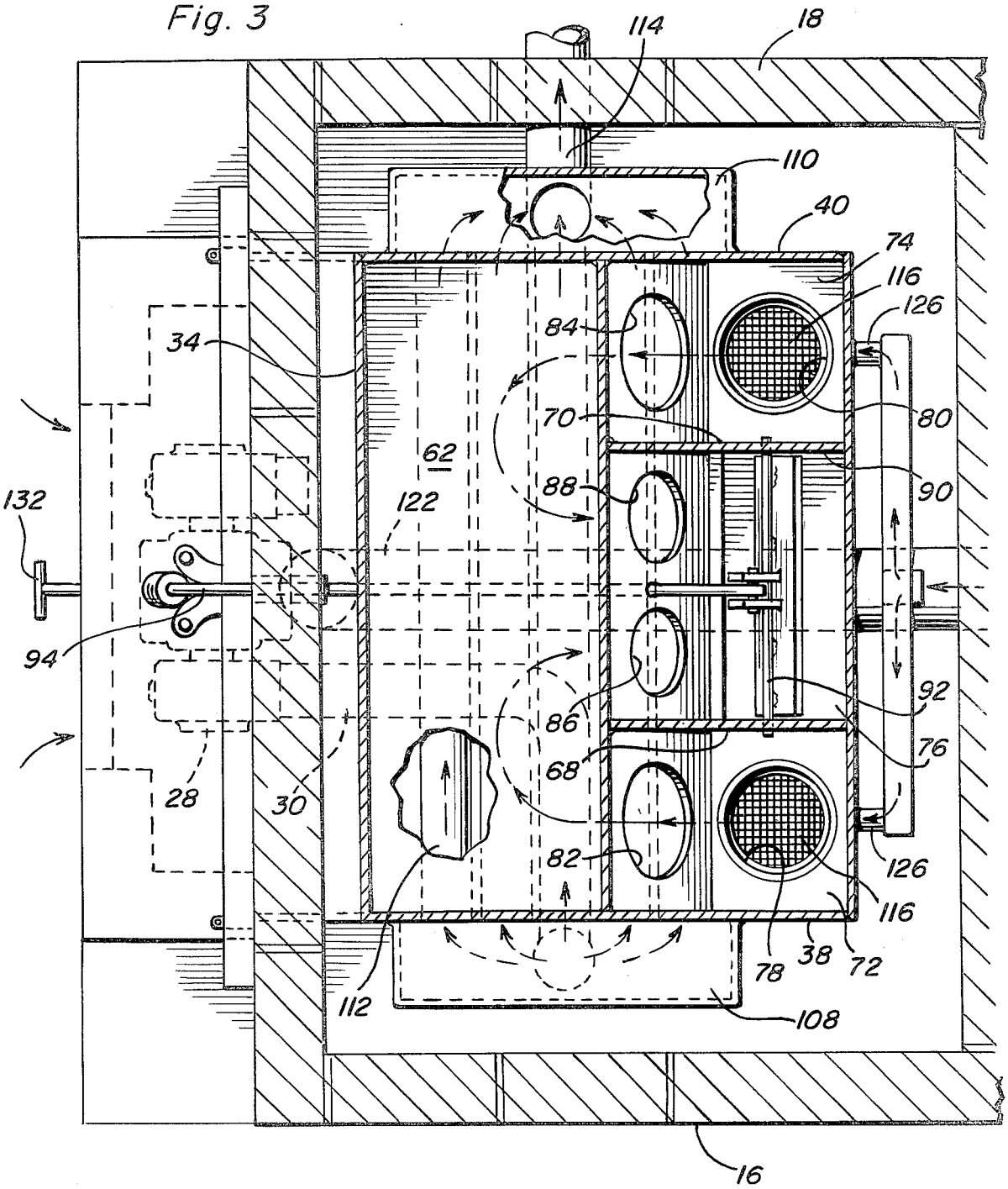
FIG. 3 is a horizontal sectional view taken substantially upon a plane passing through the upper portion of the afterburn chamber.
Figure 5:
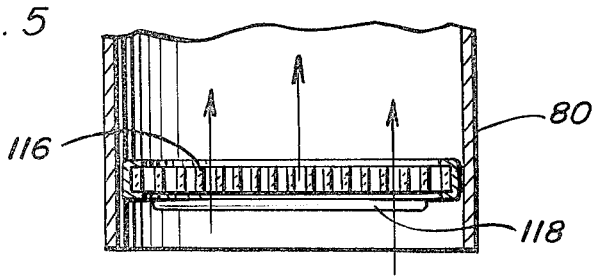
FIG. 5 is an enlarged fragmentary vertical sectional view taken substantially upon the plane indicated by the section line 5—5 of FIG. 4.

It will be noted from FIG. 2 of the drawings that the upper forward portion of the interior of the combustion chamber 58 includes a rearwardly and downardly inclined smoke lip 128. Also, the inlet 120 includes a damper plate 130 provided with a forwardly projecting oscillatable control rod 132 from which the damper plate is supported and the forward end of the rod 132 includes a laterally directed handle 134. Accordingly, the flow of combustion air through the inlet 120 may be varied as desired. Although it has not been found necessary to provide a damper or other control for the inlet pipe 124 whereby the flow of air through the discharge tubes 126 may be adjusted, such a control may be provided, if desired. The inlet pipe 124 is not disposed within the firebox 32, but is positioned closely adjacent the rear wall 35 thereof whereby the pipe 124 is heated by radiant heat. Accordingly, the air being discharged from the tubes 126 is heated after the firebox 32 has reached operating temperature. Accordingly, when the damper plate 92 is closed to place the combusters 116 in operation, the discharge of supplemental combustion air from the tubes 126 does not adversely reduce the temperature of the unburned gases passing through the combusters or the combusters themselves and thereby assures that once the firebox 32 has reached operating temperature the unburned gases in the upper portion of the combustion chamber 58, after having supplemental combustion air admixed therewith, will be completely burned as they pass through the combusters 116.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A catalytic firebox including a housing defining a closed lower combustion chamber, a closed upper afterburn chamber disposed above said combustion chamber with one marginal portion of said combustion chamber projecting horizontally outwardly beyond the corresponding marginal portion of said afterburn chamber and a combined flue gas and bypass chamber disposed above said one marginal portion of said combustion chamber and horizontally registered with said afterburn chamber, means dividing said combined chamber into central and remote portions spaced along said one marginal portion, a pair of first port means communicating said remote portions of said combined flue gas and bypass chamber with corresponding remote upper portions of said combustion chamber, a pair of second port means communicating said remote portions of said combined flue gas and bypass chamber with corresponding remote portions of said afterburn chamber, third port means communicating a central portion of said afterburn chamber with said central portion of said combined flue gas and bypass chamber, fourth port means communicating said central portion of said combined flue gas and bypass chamber with a central upper portion of said one marginal portion of said combustion chamber, and catalytic combuster means disposed in said first port means, damper means operatively associated with said fourth port means for variably opening and closing the latter, flue gas outlet means opening outwardly of said central portion, combustion air inlet means opening into said combustion chamber, and supplemental combustion air inlet means opening into said combustion chamber closely adjacent said combuster means.

2. The firebox of claim 1 wherein said housing indicates front and rear portion, said front portion including an access opening and closure means for removably closing said access opening.

3. The firebox of claim 2 wherein said one marginal portion comprises said rear portion.

4. The firebox of claim 3 wherein said remote portions of said afterburn chamber comprise opposite side portions thereof.

5. The firebox of claim 1 wherein said first port means includes a pair of downwardly projecting tubes including greater portions of their length disposed in the upper portion of said combustion chamber, said combusters being mounted within lower portions of said tubes.

6. The firebox of claim 1 wherein said combustion chamber includes heating air pipes extending therethrough and opening outwardly of remote marginal portions of the upper portion of said firebox, means for admitting air to be heated into one set of corresponding ends of said tubes and for ducting heated air away from the other set of corresponding ends of said tubes to a remote location.

7. The firebox of claim 6 wherein said means for admitting air into one set of ends of said heating air pipes includes a manifold box into which said one set of ends of said heating air pipes open and air pump means for pumping air into said manifold box.

8. The firebox of claim 7 wherein said firebox is at least substantially fully enclosed within a fireproof enclosure, said fireproof enclosure including air inlet means and air outlet means, said air pump means being operatively associated with said air inlet means for receiving air therefrom, said air pump means including a first portion operable to pump air from said air inlet means to said manifold box and second means operative to pump air from said inlet means directly into the interior of said enclosure.

9. The firebox of claim 8 wherein said housing includes front and rear portions, said front portion including an access opening and closure means for removably closing said access opening.

10. The firebox of claim 9 wherein said one marginal portion comprises said rear portion.

11. The firebox of claim 10 wherein said remote portions of said afterburn chamber comprise opposite side portions thereof.

12. The firebox of claim 8 wherein said first port means includes a pair of downwardly projecting tubes including greater portions of their length disposed in the upper portion of said combustion chamber, said combusters being mounted within lower portions of said tubes.

* * * * *